US009353610B2

(12) United States Patent
Smith et al.

(10) Patent No.: US 9,353,610 B2
(45) Date of Patent: May 31, 2016

(54) COMPACT WELLHEAD SYSTEM WITH BUILT-IN PRODUCTION CAPABILITY

(71) Applicant: NATIONAL OILWELL VARCO, L.P., Houston, TX (US)

(72) Inventors: Graeme Hearns Smith, Aberdeen (GB); Jock Irvine, Mid Lothian (GB)

(73) Assignee: National Oilwell Varco, L.P., Houston, TX (US)

( * ) Notice: Subject to any disclaimer, the term of this patent is extended or adjusted under 35 U.S.C. 154(b) by 571 days.

(21) Appl. No.: 13/782,146

(22) Filed: Mar. 1, 2013

(65) Prior Publication Data

US 2014/0246197 A1 Sep. 4, 2014

(51) Int. Cl.

| | |
|---|---|
| ***E21B 33/068*** | (2006.01) |
| ***E21B 43/12*** | (2006.01) |
| ***E21B 43/16*** | (2006.01) |
| ***E21B 33/03*** | (2006.01) |

(52) U.S. Cl.

CPC ..... *E21B 43/162* (2013.01); *E21B 33/03* (2013.01)

(58) Field of Classification Search

CPC ..... E21B 33/047; E21B 33/03; E21B 33/068; E21B 43/162; E21B 33/04

See application file for complete search history.

(56) References Cited

U.S. PATENT DOCUMENTS 5,465,794 A * 11/1995 McConaughy ..... E21B 33/04 166/375
6,062,314 A * 5/2000 Nobileau ..... A61C 13/0003 166/368
6,394,194 B1 5/2002 Queen
7,063,160 B2 * 6/2006 Fenton ..... E21B 33/043 166/368
8,286,713 B2 * 10/2012 Broussard ..... E21B 23/01 166/338
8,371,385 B2 * 2/2013 Lewis ..... E21B 33/035 166/341

(Continued)

FOREIGN PATENT DOCUMENTS

GB 2326430 A 12/1998

OTHER PUBLICATIONS

Wood Group Pressure Control Brochure, "9-5/8" 7" × 3-1/2" 3M 9" 3M STS System with STS Tubing Head" (Jun. 2008) (1 p.).

(Continued)

*Primary Examiner* — Daniel P Stephenson

(74) *Attorney, Agent, or Firm* — Conley Rose, P.C.

(57) ABSTRACT

A production system for producing hydrocarbons from a subterranean reservoir includes a wellhead including a housing and a head. The housing has a central axis, an upper end, a lower end, and an inner surface. The inner surface defines a passage extending axially through the housing. In addition, the inner surface of the housing includes an annular recess positioned between the upper end and the lower end. The housing also includes a first production port extending radially through the housing. Further, the system includes a casing hanger disposed within the housing. The casing hanger has an upper end, a lower end, an outer surface, and a through bore extending from the upper end to the lower end. The casing hanger also includes a plurality of circumferentially-spaced ports extending radially through the casing hanger from the through bore to the annular recess of the housing.

18 Claims, 7 Drawing Sheets

(56) References Cited

U.S. PATENT DOCUMENTS

2002/0117298 A1* 8/2002 Wong ..... E21B 33/068 166/86.1
2009/0260832 A1 10/2009 Fenton
2010/0218939 A1* 9/2010 McGuire ..... E21B 17/1007 166/88.1
2011/0017467 A1* 1/2011 June ..... E21B 33/043 166/368
2013/0014947 A1* 1/2013 Wilkins ..... E21B 43/26 166/281
2014/0246197 A1* 9/2014 Smith ..... E21B 33/03 166/305.1
2015/0159458 A1* 6/2015 Tan ..... E21B 33/0422 166/348

OTHER PUBLICATIONS

Stafford Design Service Brochure, "Mini Unihead Wellhead System Disk," http://stafford-design.com/tplstd.asp? page=291 (1996) (1 p.).
PCT International Search Report and Written Opinion dated Dec. 11, 2014, for International Application No. PCT/US2014/015495, International filing date Feb. 10, 2014.

* cited by examiner

COMPACT WELLHEAD SYSTEM WITH BUILT-IN PRODUCTION CAPABILITY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to wellheads. More particularly, the disclosure relates to compact wellheads with production capabilities.

Conventional well production systems for the recovery of oil and gas from a hydrocarbon bearing formation include a borehole extending from the surface into an earthen formation, a wellhead disposed connected to an upper end of an outer casing or primary conductor lining the borehole, and a production tree attached to the wellhead. A casing hanger and a tubing hanger are often housed within the wellhead. A string of inner casing is hung from the casing hanger through the outer casing and into the borehole. Production tubing is hung from the tubing hanger through the inner casing. The production tubing functions as a conduit for formation fluids to flow upward to the wellhead and production tree at the surface. The tubing hanger may support an additional fluid conduits for injecting fluids into the borehole. For instance, fluid may be injected into the borehole during production in order to maintain fluid pressure within the borehole to allow for the more efficient recovery of hydrocarbons from the formation. In some production systems, an annulus formed between the conduits hung from the tubing hanger and the casing may provide an additional passage for produced fluids.

The production tree typically includes an assembly of valves and spools configured to control the flow of fluid passing into or out of the borehole through the production tubing and the wellhead. For instance, following drilling and the completion of the well, valves included in the tree may be opened to allow for the recovery of formation fluid from the borehole.

Typical wellheads in land operations have a relatively large a footprint (i.e., width or diameter), thereby preventing them from being run or passed through the rotary table of the drilling rig for mounting to the upper end of the outer casing. Consequently, wellheads are typically swung below the deck of the drilling rig for installation. This can be a relatively difficult and hazardous process. In addition, some conventional wellheads only allow for the installation of a single type or style of tubing hanger (e.g., concentric or dual bore), which limits flexibility and potentially limits production capabilities.

BRIEF SUMMARY OF THE DISCLOSURE

These and other needs in the art are addressed in one embodiment by a production system for producing hydrocarbons from a subterranean reservoir. In an embodiment, the production system comprises a wellhead including a housing and a head mounted to the housing. The housing has a central axis, an upper end, a lower end configured to be directly attached to an upper end of a primary conductor, and an inner surface extending axially between the upper end and the lower end. The inner surface defines a passage extending axially through the housing. The inner surface of the housing includes an annular recess axially positioned between the upper end and the lower end. The housing includes a first production port extending radially through the housing from the annular recess to a radially outer surface of the housing. In addition, the production system comprises a casing hanger disposed within the housing, the casing hanger having an upper end, a lower end, an outer surface, and a through bore extending from the upper end to the lower end. The casing hanger includes a plurality of circumferentially-spaced ports extending radially through the casing hanger from the through bore to the annular recess of the housing.

These and other needs in the art are addressed in one embodiment by a production system for producing hydrocarbons from a subterranean reservoir. In an embodiment, the production system comprises a wellhead including a housing having a central axis, an upper end, a lower end configured to be directly attached to an upper end of a primary conductor, and an inner surface extending axially between the upper end and the lower end. The inner surface defines a passage extending axially through the housing. In addition, the system comprises a casing hanger disposed within the housing. The casing hanger has an upper end, a lower end, an outer surface, and a through bore extending from the upper end to the lower end. Further, the system comprises a casing string coupled to the lower end of the casing hanger. Still further, the system comprises a tubing hanger disposed within the housing. The tubing hanger having an upper end, a lower end, an outer surface and a through bore extending from the upper end to the lower end. The tubing hanger is seated against an annular landing surface disposed at the upper end of the casing hanger. Moreover, the system comprises a tubing string coupled to the lower end of the tubing hanger and extending through the casing string. A first production port in the housing is in fluid communication with a first annulus radially disposed between the primary conductor and the casing string and a second production port in the housing is in fluid communication with a second annulus radially disposed between the casing string and the tubing string.

These and other needs in the art are addressed in one embodiment by a method for producing hydrocarbons from a subterranean reservoir. In an embodiment, the method comprises (a) flowing a first fluid stream radially through a casing hanger into an annular recess formed on the inner surface of a wellhead secured to an upper end of a primary conductor. In addition, the method comprises (b) flowing the first fluid stream through the annulus to a first production port extending radially through the housing.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
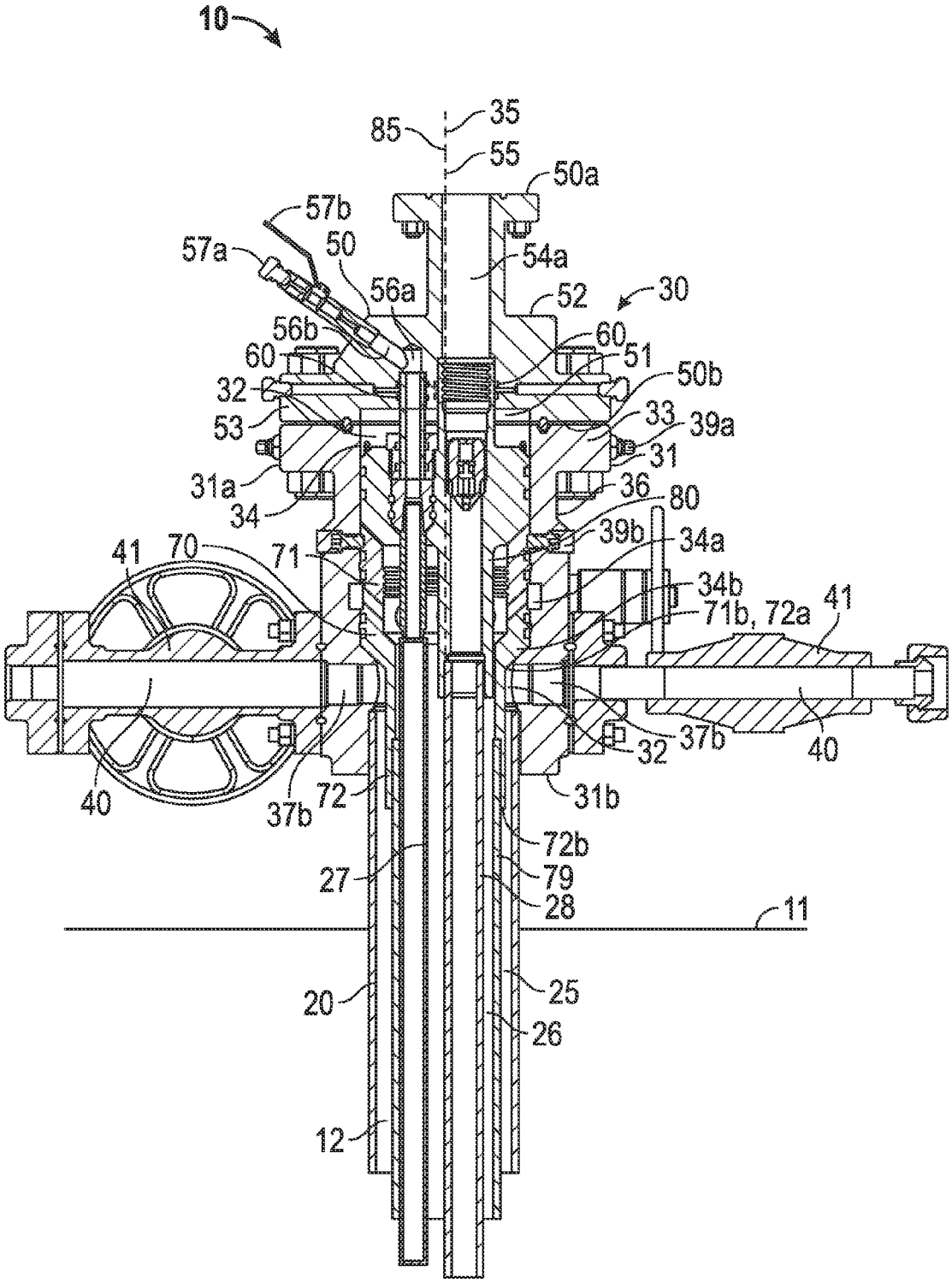
FIG. 1 is a partial cross-sectional view of an embodiment of a system in accordance with the principles described herein for producing hydrocarbons from a subterranean reservoir.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims will be made for purposes of clarity, with "up", "upper", "upwardly" or "upstream" meaning toward the surface of the borehole and with "down", "lower", "downwardly" or "downstream" meaning toward the terminal end of the borehole, regardless of the borehole orientation. Any reference to up or down in the description and the claims will be made for purpose of clarification, with "up", "upper", "upwardly" or "upstream" meaning toward the surface of the borehole and with "down", "lower", "downwardly" or "downstream" meaning toward the terminal end of the borehole, regardless of the borehole orientation.

Figure 2:
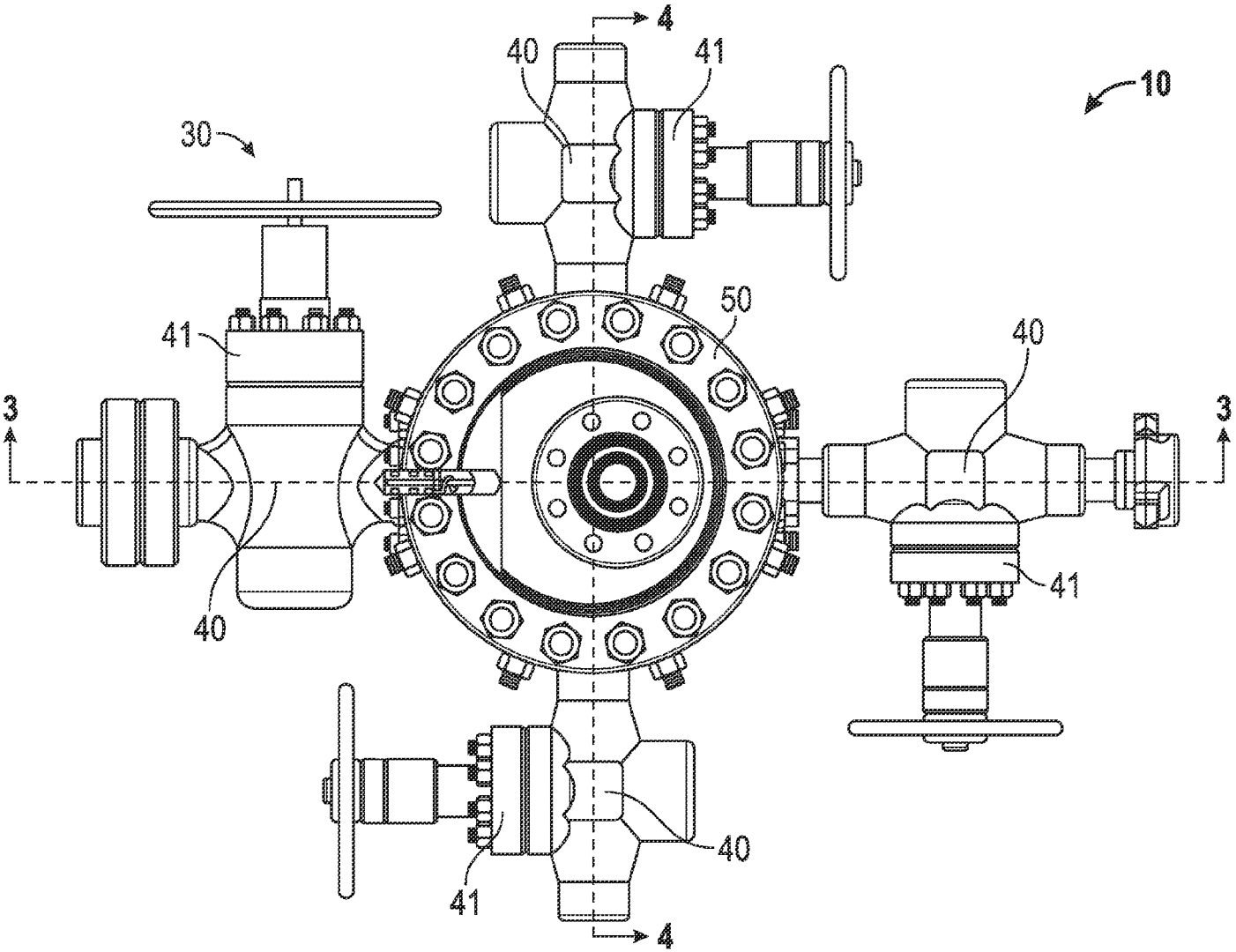
FIG. 2 is a top view of the wellhead of FIG. 1.

Referring now to FIGS. 1 and 2, an embodiment of a production system 10 for producing hydrocarbons from a subterranean reservoir is shown. In this embodiment, production system 10 includes primary conductor or outer casing 20 extending from the surface 11 and lining a subterranean borehole 12, a compact wellhead 30 mounted to the upper end of casing 20, a casing hanger 70 seated in wellhead 30, and a tubing hanger 80 seated in wellhead 30. An inner casing string 71 is suspended from casing hanger 70 and extends downhole through outer casing 20. A first tubing or line 27 and a second tubing or line 28 are suspended from tubing hanger 80 and extend downhole through inner casing string 71. In this embodiment, line 27 is an injection line for injecting a fluid (e.g., steam, water, carbon dioxide, etc.) into the reservoir to maintain or increase reservoir pressure for secondary recovery operations, and second line 28 is a production line for flowing hydrocarbons from the reservoir to the surface 11. A first or outer annulus 25 is formed between outer casing 20 and inner casing string 71, and a second or inner annulus 26 is formed between inner casing string 71 and lines 27, 28.

Figure 3:
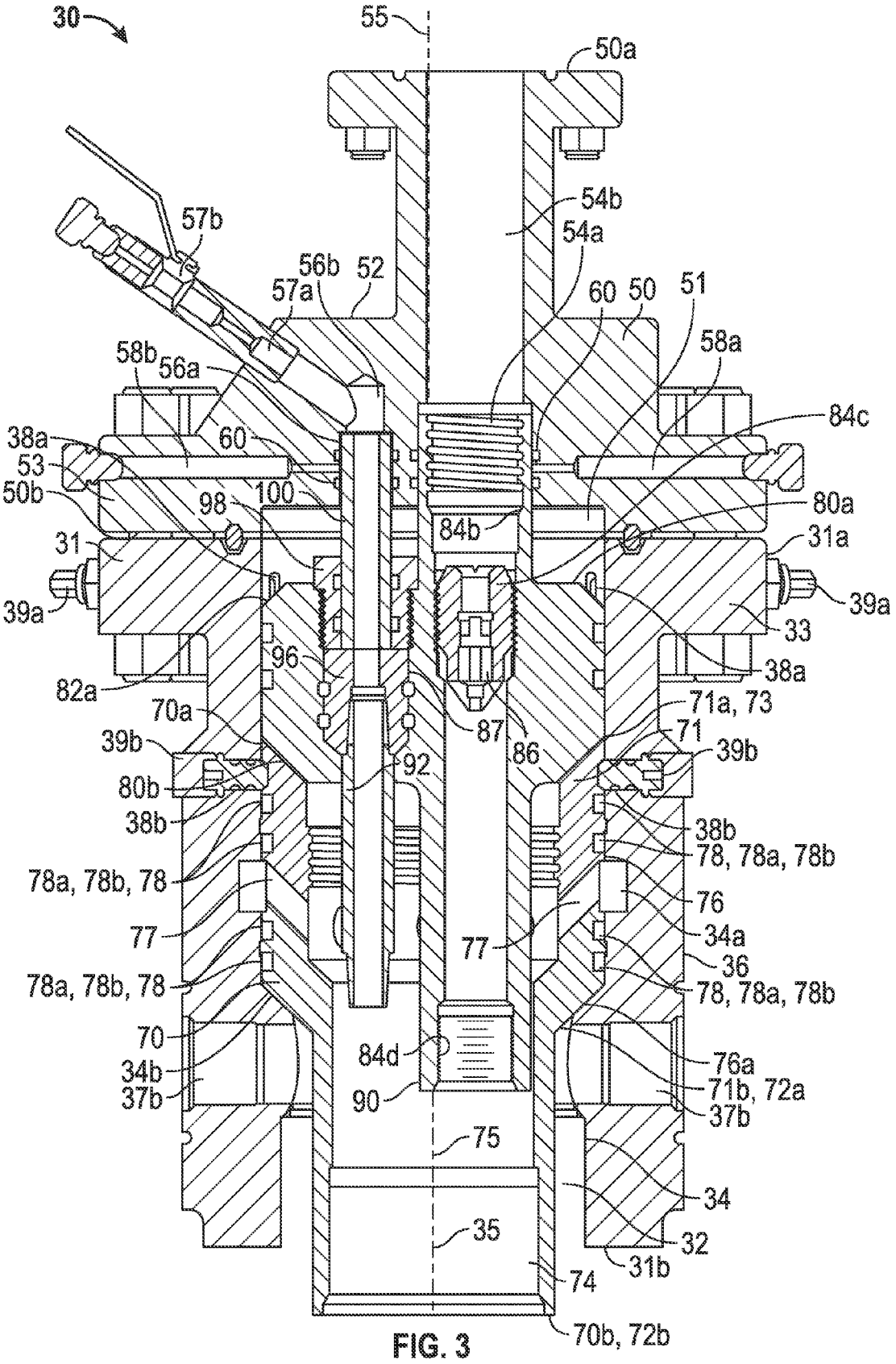
FIG. 3 is an enlarged cross-sectional view of the wellhead of FIG. 1 taken along section III-III of FIG. 2.
Figure 4:
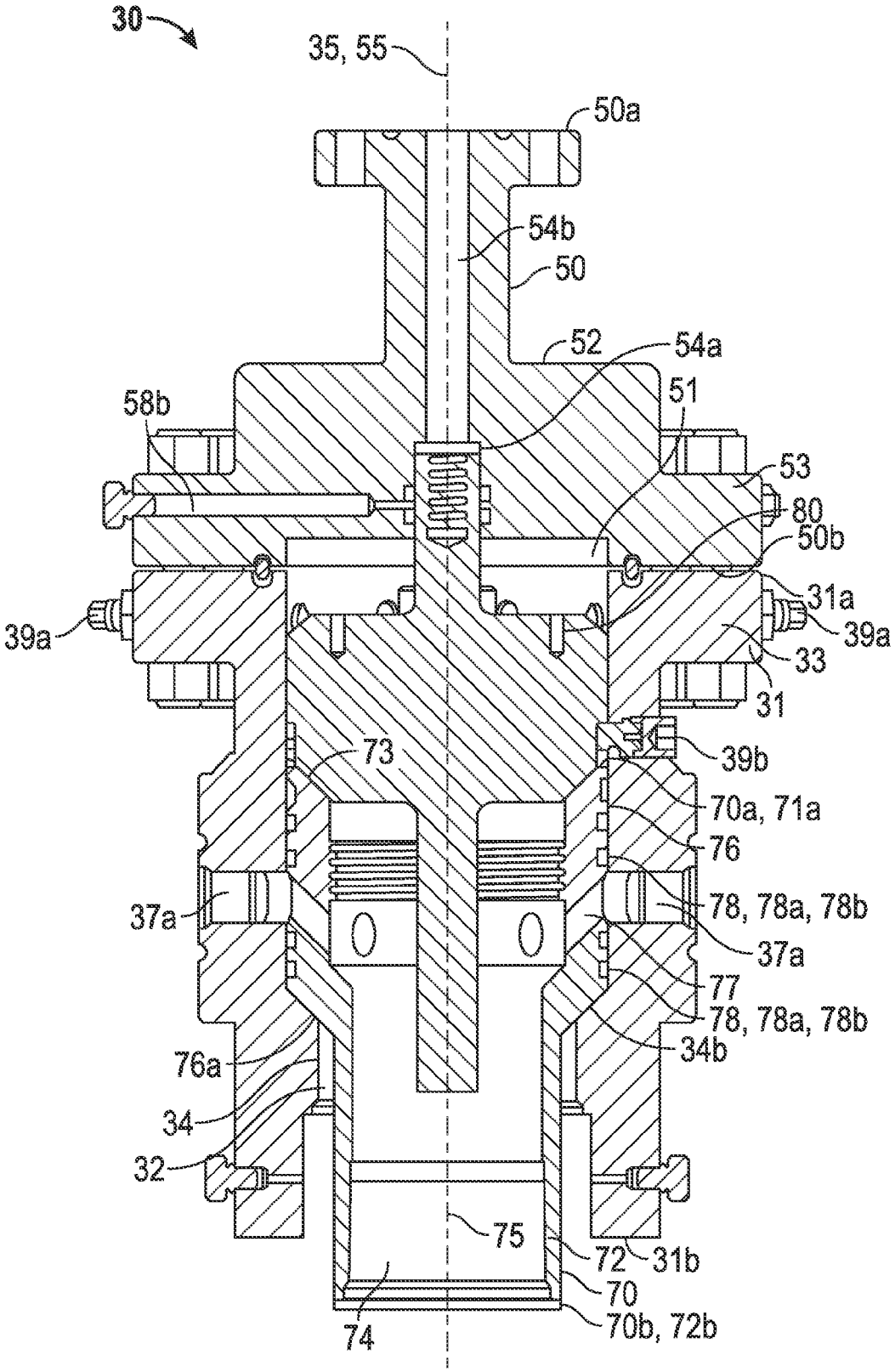
FIG. 4 is an enlarged cross-sectional view of the wellhead of FIG. 1 taken along section IV-IV of FIG. 2.
Figure 5:
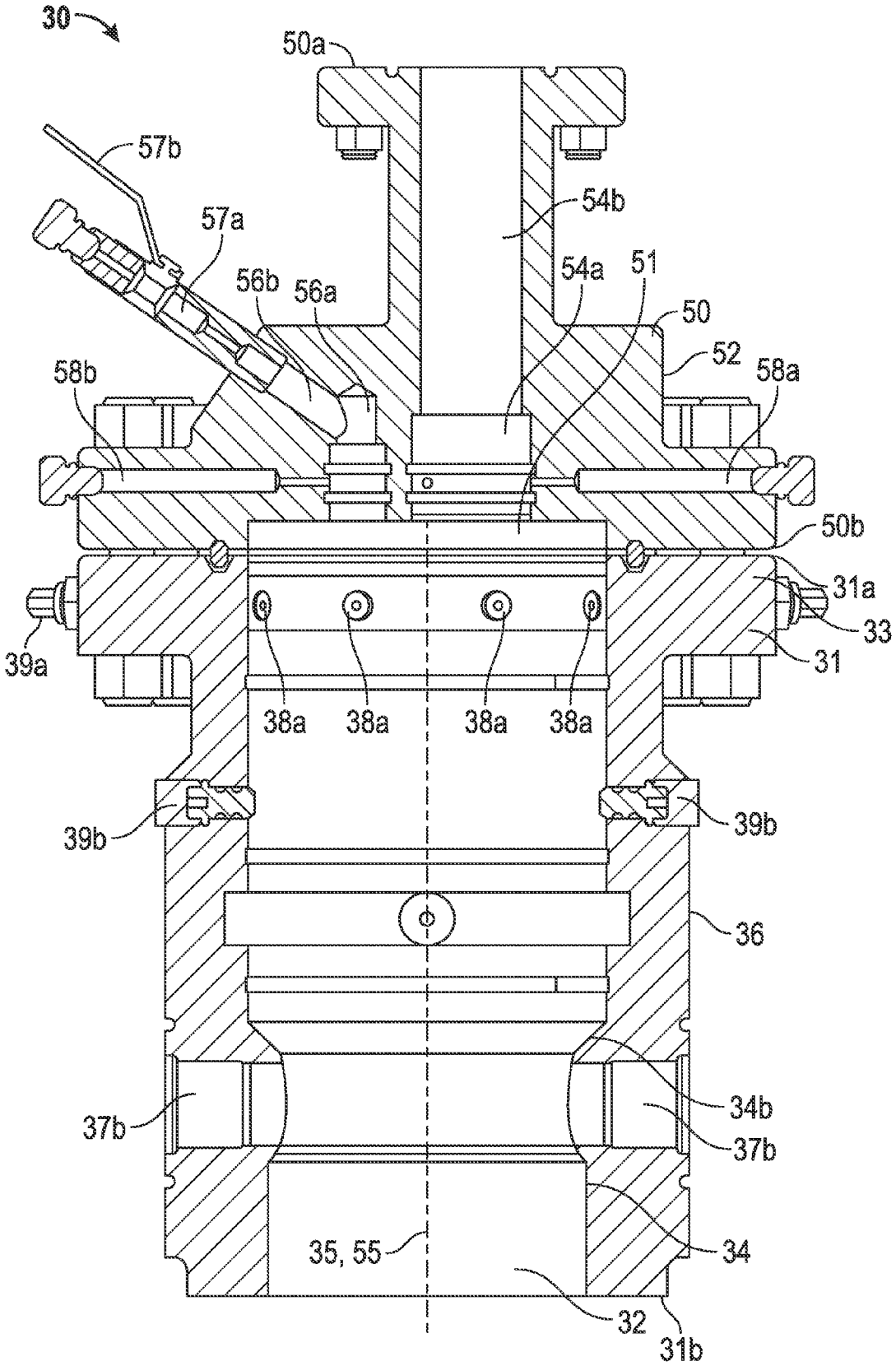
FIG. 5 is a cross-sectional view of the wellhead housing of FIG. 3.

Referring now to FIGS. 3-5, compact wellhead 30 includes a body or housing 31 and a cap or head 50 mounted to housing 31. Housing 31 has a vertical central or longitudinal axis 35, a first or upper end 31*a*, a second or lower end 31*b* opposite end 31*a*, and a through bore or passage 32 extending axially between ends 31*a*, 31*b*. A connection flange 33 is provided at upper end 31*a* for securing head 50 to housing 31. In addition, housing 31 has a radially inner generally cylindrical surface 34 extending axially between ends 31*a*, 31*b* and defining passage 32, and a radially outer surface 36 extending axially between ends 31*a*, 31*b* Inner surface 34 includes an annular recess 34*a* axially disposed between ends 31*a*, 31*b* and an annular upward-facing frustoconical shoulder 34*b* axially disposed between recess 34*a* and end 31*b*. As best shown in FIG. 1, the upper end of outer casing 20 extends axially into passage 32 of housing 31 at lower end 31*b* and is fixably secured thereto (e.g., via welding or casing thread).

Housing 31 also includes a first pair of circumferentially-spaced production passages or ports 37*a* (FIG. 4) and a second pair of circumferentially-spaced production passages or ports 37*b* (FIGS. 3 and 5). Each port 37*a*, 37*b* extends radially through housing 31 from passage 32 to outer surface 36. In particular, ports 37*a* extend radially from recess 34*a* to outer surface 36. Thus, ports 37*a* are disposed at the same axial position. Ports 37*b* are also disposed at the same axial position, but are disposed axially below ports 37*a*. In this embodiment, ports 37*a* are uniformly angularly spaced 180° apart, and ports 37*b* are uniformly angularly spaced 180° apart. However, ports 37*a* are angularly-spaced 90° from ports 37*b*. A plurality of outlet conduits 40 are attached to housing 31. Each conduit 40 is in fluid communication with one production port 37*a*, 37*b* and includes a valve 41 for controlling the flow of fluids therethrough. As will be described in more detail below, reservoir fluids can be produced through ports 37*a* and/or ports 37*b* and the corresponding conduit(s) 40.

Referring still to FIGS. 3-5, a first plurality of uniformly circumferentially-spaced bores 38*a* are axially positioned proximal upper end 31*a* and a second plurality of uniformly circumferentially-spaced bores 38*b* are axially positioned between bores 38*a* and recess 34*a*. Each bore 38*a*, 38*b* extends radially through housing 31 from passage 32 to outer surface 36 and is internally threaded. A retention pin 39*a* is disposed within each bore 38*a*, and a retention pin 39*b* is disposed within each bore 38*b*. In this embodiment, retention pins 39*a*, 39*b* include external threads that engage mating internal threads provided in bores 38*a*, 38*b*, respectively. As will be described in more detail below, retention pins 39*a* are threaded through bores 38*a* into engagement with tubing hanger 80 (FIG. 4) and retention pins 39*b* are threaded through bores 38*b* into engagement with casing hanger 70. Although this embodiment includes upper and lower bores 38*a*, 38*b* and corresponding retention pins 39*a*, 39*b*, in other embodiments, upper bores 38*a* and corresponding retention pins 39*a* are provided, however, lower bores 38*b* and corresponding retention pins 39*b* are eliminated. Although retention pins 39*a*, 39*b* are threaded into and out of mating bores 38*a*, 38*b*, respectively, in this embodiment to move them radially inward and outward, respectively, in other embodiments, the retention pins (e.g., pins 39*a*, 39*b*) are secured in mating bores and biased radially inward (e.g., via springs).

Referring still to FIGS. 3-5, head 50 has a central axis 55, a first or upper end 50*a*, a second or lower end 50*b*, a cylindrical recess 51 extending axially from lower end 50*b*, and an outer surface 52 extending between ends 50*a*, 50*b*. A connection flange 53 is provided at lower end 50*b* for securing head 50 to housing 31. In particular, head 50 is coaxially aligned with housing 31 and flanges 33, 53 are bolted together, thereby closing off passage 32 in housing 31 at upper end 31*a*.

A first cylindrical counterbore 54*a* extends axially from recess 51 and a through bore or passage 54*b* extends axially from counterbore 54*a* to upper end 50*a*. A second cylindrical counterbore 56*a* extends axially from recess 51 and a through bore or passage 56*b* extends axially upward and radially outward from counterbore 56*a* to outer surface 52. Counterbores 54*a*, 56*a* are radially offset from central axis 55. A conduit 57*a* is attached to head 50 and in fluid communication with passage 56*b*. A valve 57*b* is provided along conduit 57*a* for controlling fluid flow through passage 56*b*. In addition, a first access port 58*a* extends radially from counterbore 54*a* to outer surface 52 and a second access port 58*b* extends radially from counterbore 56*a* to outer surface 52. Each port 58*a*, 58*b* is closed off and sealed with a plug 59.

A pair of axially-spaced annular seal assemblies 60 are provided within each counterbore 54*a*, 56*a*. Within each counterbore 54*a*, 56*a*, the two seal assemblies 60 are disposed axially above-and-below port 58*a*, 58*b*, respectively. In this embodiment, each seal assembly 60 includes an annular recess formed along the inner surface of the corresponding counterbore 54*a*, 56*a*, and an annular seal member (e.g., O-ring seal) seated in the recess. As will be described in more detail below, seal assemblies 60 form annular seals between head 50 and tubular components seated within counterbores 54*a*, 56*a*.

It should be appreciated that the inner end of first access port 58*a* is disposed between seal assemblies 60 provided in counterbore 54*a*, and the inner end of second access port 58*b* is disposed between seal assemblies 60 provided in counterbore 56*a*. Thus, access ports 58*a*, 58*b* provide a means for testing and monitoring the integrity of the annular seals formed with seal assemblies 60 in counterbores 54*a*, 56*a*, respectively. For example, access port 58*a* can be used to pressure test seal assemblies 60 in counterbore 54*a* to determine if they are sufficiently sealing; and access port 58*b* can be used to pressure test seal assemblies 60 in counterbore 56*a* to determine if they are sufficiently sealing.

Referring now to FIGS. 3 and 4, casing hanger 70 has a central axis 75, a first or upper end 70*a*, and a second or lower end 70*b*. In addition, hanger 70 includes a tubular body 71 and a tubular connector 72 extending downward from body 71. Body 71 has a first or upper end 71*a* defining upper end 70*a* of hanger 70 and a second or lower end 71*b*, and connector 72 has a first or upper end 72*a* integral with lower end 71*b* of body and a lower end 72*b* defining lower end 70*b* of hanger 70. Upper end 70*a*, 71*a* comprises an annular upward-facing frustoconical surface 73. In this embodiment, frustoconical surface 73 is oriented at 45° relative to axis 75. As will be described in more detail below, tubing hanger 80 is seated in surface 73, and thus, surface 73 may also be referred to as an annular seat. A central through bore or passage 74 extends axially between ends 70*a*, 70*b* through body 71 and connector 72.

Hanger 70 has a radially outer surface 76 extending between ends 70*a*, 70*b*. Surface 76 includes an annular downward-facing frustoconical shoulder 76*a* at the intersection of body 71 and connector 72, and an annular recess 76*b* proximal upper end 70*a*. A plurality of circumferentially-spaced ports 77 extend radially through body 71 from passage 74 to outer surface 76. Ports 77 are axially positioned between ends 71*a*, 71*b*. In this embodiment, hanger 70 includes eight ports 77 uniformly angularly-spaced 45° apart about axis 75. However, in other embodiments the number and angular positions of the radial ports (e.g., ports 77) may vary. A plurality of annular seal assemblies 78 are disposed along outer surface 76 for sealingly engaging body 71 and wellhead housing 31. In particular, a pair of upper seal assemblies 78 are disposed about body 71 axially above ports 77, and a pair of lower seal assemblies 78 are disposed about body 71 axially below ports 77. In this embodiment, each seal assembly 78 includes an annular seal gland or recess 78*a* in outer surface 76 and an annular seal member 78*b* (e.g., O-ring seal) seated in gland 78*a*.

As best shown in FIGS. 1 and 3, connector 72 extends vertically downward from body 72 and includes internal threads at lower end 72*b* for threadably engage mating external threads at the upper end of inner casing 82, thereby coupling casing 82 to casing hanger 70.

Casing hanger 70 is disposed in housing 31 and seated on shoulder 34*b*. In particular, shoulder 76*a* of casing hanger 70 axially abuts and engages mating shoulder 34*b*. Hanger 70 is sized and configured such that radial ports 77 are axially aligned with annular recess 34*a*, and annular recess 76*b* is axially aligned with retention pins 39*b*. Alignment of ports 77 and recess 34*a* provides fluid communication between passage 74 of hanger 70 and ports 37*a*. Alignment of recess 76*b* with retention pins 39*b* enables retention pins 39*b* to be radially advanced into positive engagement with recess 76*b*, thereby preventing relative axial movement between casing hanger 70 and housing 31.

Body 71 has an outer diameter that is substantially the same as the inner diameter of housing 31, and thus, body 71 slidingly engages housing 31. This enables seal assemblies 78 to form annular seals between body 71 and housing 31 axially above and below ports 77, thereby restricting and/or preventing the flow of fluids between outer surface 76 and housing 31.

Figure 6:
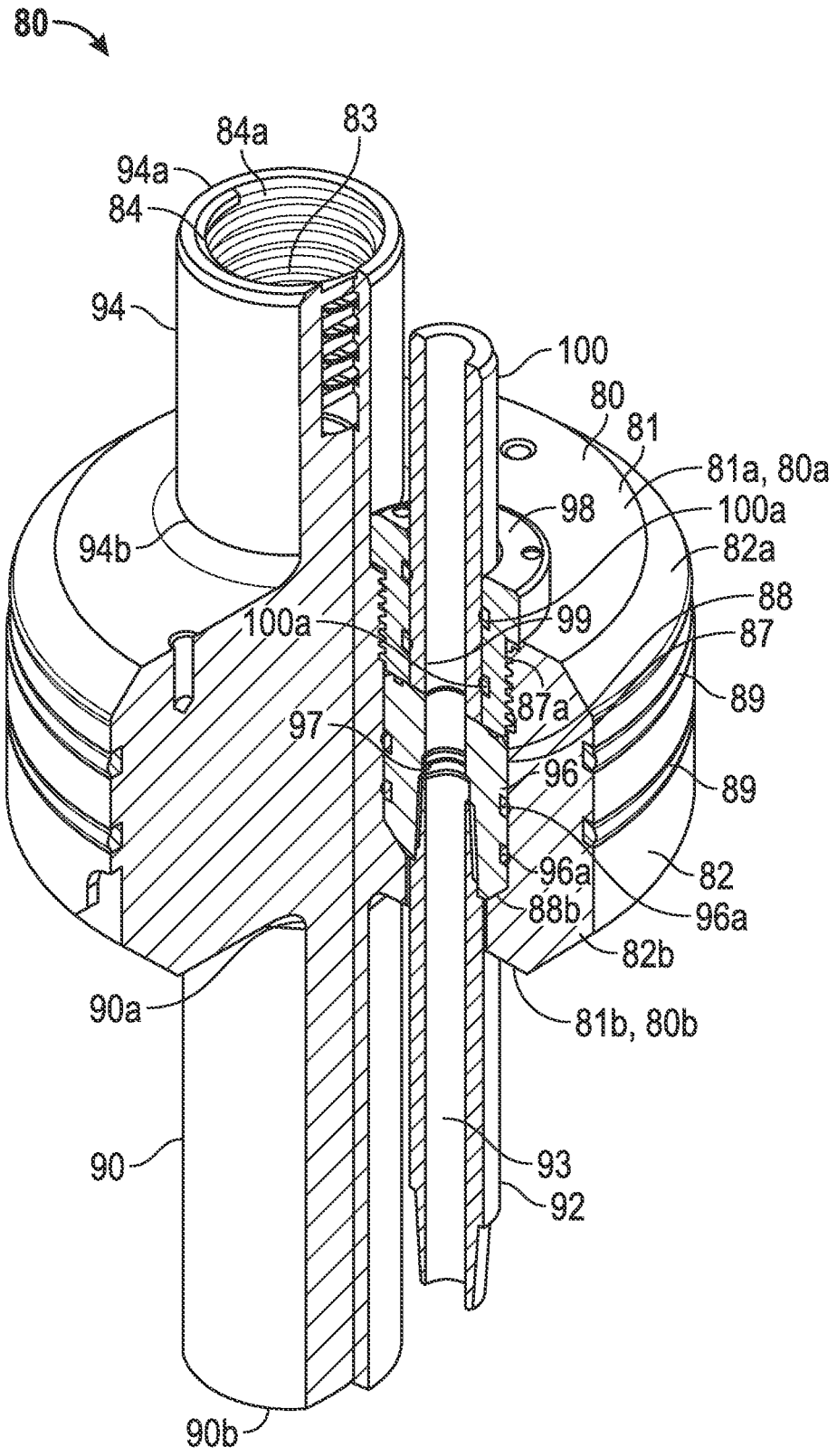
FIG. 6 is a perspective sectional view of the tubing hanger of FIG. 3.

Referring now to FIGS. 3, 4, and 6, tubing hanger 80 is disposed within housing 31 and has a central axis 85, a first or upper end 80*a*, and a second or lower end 80*b* opposite end 80*a*. Axis 85 is aligned with axis 35 of housing 31. In addition, tubing hanger 80 includes a generally cylindrical body 81, a pair of tubular connectors 90, 92 extending axially downward from body 81, and a tubular penetrator 94 extending axially upward from body 81.

Body 81 has a first or upper end 81*a* defining end 80*a* and a second or lower end 81*b*. Tubular connectors 90, 92 extend downward from lower end 81*b*, and tubular penetrator 94 extends upward from upper end 81*a*. In addition, body 81 has a radially outer surface 82 extending axially between ends 81*a*, 81*b*. In this embodiment, outer surface 82 includes an annular frustoconical surface 82*a* at upper end 81*a*, an annular downward-facing frustoconical shoulder 82*b* at lower end 81*b*, and a cylindrical surface 82*c* extending axially between surface 82*a* and shoulder 82*b*. In this embodiment, each surface 82*a*, 82*c* is oriented at 45° relative to axis 85. Tubing hanger 80 is seated in passage 32 of housing 31 with shoulder 82*b* seated against upward-facing seat 73 of casing hanger 70. A pair of annular seal assemblies 89 are radially disposed between body 81 and housing 31, thereby preventing fluid flow therebetween. Frustoconical surface 82*a* is releasably engaged by retention pins 39*a*, shoulder 82*b* axially abuts and engages annular seat 73 of casing hanger 70, and cylindrical surface 82*c* slidingly engages housing 31. Retention pins 39*a* are radially advanced into engagement with surface 82*a*, thereby urging tubing hanger 80 axially downward into engagement with seat 73 and preventing tubing hanger 80 from moving axially relative to casing hanger 70 and housing 31.

Connector 90 has a first or upper end 90*a* integral with body 81 and a second or lower end 90*b* distal body 81. Penetrator 94 includes a first or upper end 94*a* distal body 81 and a second or lower end 94*b* integral with body 81. Connector 90 and penetrator 94 are coaxially aligned, and a cylindrical production bore 83 extends axially through tubing hanger 80 from upper end 94*a* to lower end 90*b*. In other words, bore 83 extends axially through penetrator 94, body 81, and connector 90. Bore 83 is coaxially aligned with connector 90 and penetrator 94, but is radially offset from central axis 85. In particular, bore 83 has a central axis that is parallel to axis 85 and radially spaced from axis 85. Bore 83 is defined by an inner surface 84 extending axially between ends 94*a*, 90*b*. Inner surface 84 includes an internally threaded upper section 84*a* at upper end 94*a*, an annular upward-facing shoulder 84*b* axially disposed between ends 94*a*, 90*b*, an internally threaded intermediate section 84*c* axially disposed between section 84*a* and shoulder 84*b*, and an internally threaded lower section 84*d* at lower end 90*b*. In this embodiment, a backpressure valve 86 is threaded into intermediate section 84*c* and seated against shoulder 84*c*. Valve 86 controls fluid flow through production bore 83. Tubing 27 is connected to connector 90 via section 84*d* and extends downward therefrom. Penetrator 94 extends axially into counterbore 54 and slidingly engages head 50. Seal assemblies 60 disposed within counterbore 54 form annular seals between penetrator 94 and head 50.

Referring still to FIGS. 3, 4, and 6, body 81 also includes a through bore 87 extending axially from upper end 81*a* to lower end 81*b*. Bore 87 has a central axis oriented parallel to axis 85 and radially offset from axis 85. Bore 87 is defined by an inner surface 88 including an internally threaded upper section 88*a* at upper end 81*a* and upward-facing frustoconical seat or shoulder 88*b* axially disposed between section 88*a* and lower end 81*b*. A generally cylindrical tubing mandrel 96 is slidingly disposed within bore 87 and seated against shoulder 88*b* and a lock nut 98 is threaded into upper section 88*a*. A pair of annular seal assemblies 96*a* are radially positioned between mandrel 96 and body 81, thereby preventing fluid flow therebetween. Nut 98 axially abuts mandrel 96, thereby preventing mandrel 96 from moving axially relative to body 81.

Mandrel 96 includes an injection passage 97 extending axially therethrough. The upper end of connector 92 is threaded into passage 97, and tubing 28 is threaded onto the lower end of connector 92, thereby coupling tubing 28 to body 81. Connector 92 includes a central through bore or passage 93 in fluid communication with a passage 97 and tubing 28.

Lock nut 98 includes a through bore 99 extending axially therethrough and in fluid communication with passage 97. A tubular penetrator 100 extends between lock nut 98 and head 50. In particular, penetrator 100 has a lower end slidingly disposed in bore 99 and axially abutting mandrel 96, and an upper end slidingly received by counterbore 56*a*. A pair of annular seal assemblies 100*a* are radially positioned between penetrator 100 and lock nut 98, and annular seal assemblies 60 are radially positioned between penetrator 100 and head 50.

In the manner described, production system 10 provides for multiple independent flow paths for producing fluids and a flow path for injecting fluids. Specifically, a first production fluid flowpath 110 between production tubing 28 and passage 54*b* in head 50 is provided; a second production flowpath 112 between inner annulus 26 and production ports 37*a* is provided; and a third production flowpath 114 between outer annulus 25 and ports 37*a* is provided. In addition, an injection flowpath 116 between conduit 57*a* and injection line 27 is provided.

It should also be appreciated that casing hanger 70 and tubing hanger 80 are in a "stacked" arrangement within housing 31 of wellhead 30. Such stacked arrangement allows ports 37*a*, 37*b* to be axially spaced from one another, allowing for a relatively reduced diameter of the outer surface 36 of housing 31 relative to other wellhead designs. This reduction in diameter of the outer surface 36 of housing 31 may allow wellhead 30 to be displaced axially through the deck of a drilling rig, such as through the aperture used by the rig's rotary table when wellhead 30 is coupled to the outer casing 20 during installation. Also, the multiple annuli design (e.g., inner annulus 25 and outer annulus 26), provides for a relatively shorter axial length of wellhead 30, positioning flanges 31 and 53 proximal the surface 11 for added convenience and safety.

In the embodiment of production system 10 described above, wellhead 30 is used in connection with a non-concentric dual-bore tubing hanger 80 (tubing hanger 80 includes two radially offset bores 83, 87 and corresponding connectors 90, 92). However, production system 10 and compact wellhead 30 can be quickly and conveniently reconfigured for use with a single or concentric tubing hanger by exchanging tubing hanger 80 and head 50 with a concentric tubing hanger and corresponding head.

Figure 7:
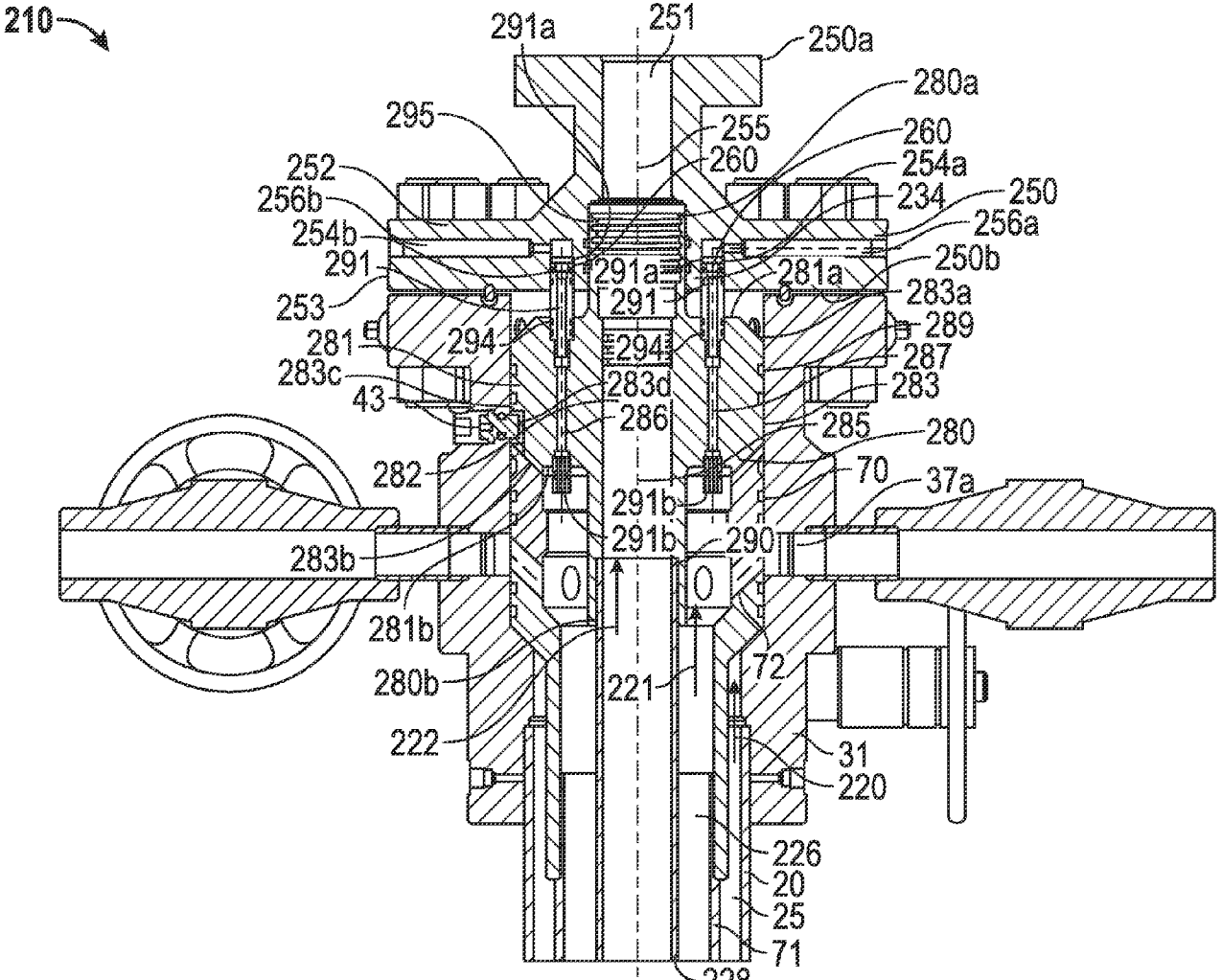
FIG. 7 is an enlarged cross-sectional view of an embodiment of a production system including the wellhead housing of FIG. 1 reconfigured to include a single bore concentric tubing hanger.

Referring now to FIG. 7, a production system 210 is shown. System 210 is substantially the same as production system 10 previously described with the exception that dual-bore tubing hanger 80 is replaced with a single bore concentric tubing hanger 280 and head 50 is replaced with a head 250 to accommodate and mate with tubing hanger 280. In particular, system 210 includes wellhead housing 31 mounted to the upper end of casing 20, casing hanger 70 seated in wellhead housing 31, inner casing string 71 suspended from casing hanger 70, tubing hanger 280 seated in wellhead housing 31 atop casing hanger 70, a tubing or line 228 suspended from tubing hanger 80, and head 250 mounted to housing 31. Housing 31, casing 20, casing hanger 70, and casing string 71 are each as previously described. In this embodiment, line 228 is a production line for flowing hydrocarbons from the reservoir to the surface 11. Outer annulus 25 is formed between outer casing 20 and inner casing string 71 as previously described, and a second or inner annulus 226 is formed between inner casing string 71 and line 228.

Referring still to FIG. 7, tubing hanger 280 has a central axis 285 coaxially aligned with axis 35 of housing 31, a first or upper end 280*a*, and a second or lower end 280*b*. In addition, tubing hanger 280 includes a generally cylindrical body 281, a tubular connector 290 extending axially downward from body 281 to lower end 280*b*, and a tubular neck 295 extending axially upward from body 281 to upper end 280*a*. Body 281, connector 290, and neck 295 are each coaxially aligned with axis 285. A production bore 282 extends axially between ends 280*a*, 280*b* through neck 295, body 281, and connector 290. Neck 295 is internally threaded at upper end 280*a*, and connector 290 is internally threaded at lower end 280*b*. Tubing 228 is connected to coupled to connector 290 via the internal threads at lower end 280*b* and extends downward therefrom.

Body 281 has a first or upper end 281*a*, a second or lower end 281*b*, and a radially outer surface 283 extending between ends 281*a*, 281*b*. Outer surface 283 includes an annular frustoconical surface 283*a* at upper end 281*a*, an annular downward-facing frustoconical shoulder 283*b* at lower end 281*b*, and a cylindrical surface 283*c* extending axially between surface 283*a* and shoulder 283*b*. In this embodiment, surface 283*a* and shoulder 283*b* are each oriented at 45° relative to axis 285. Outer surface 283 also includes a guide recess or notch 283*d* extending axially upward from shoulder 283*b* along surface 283*c*. In addition, body 281 includes a pair of bores 286, 287 extending axially between ends 281*a*, 281*b*; each bore 286, 287 is radially offset from axis 285. In an embodiment, radially offset bores 286, 287 may act as conduits for the passage of control lines or other electrical lines to downhole tools disposed in line 228.

Referring still to FIG. 7, head 250 has a central axis 255 coaxially aligned with axis 35, a first or upper end 250*a*, a second or lower end 250*b*, a central throughbore 251 extending axially between ends 250*a*, 250*b*, and an outer surface 252 extending axially between ends 250*a*, 250*b*. Lower end 250*b* comprises a connection flange 253 for securing head 250 to housing 31. In addition, a first cylindrical counterbore 254*a* and second cylindrical counterbore 254*b* extend axially upward from lower end 250*b*. Counterbores 254*a*, 254*b* are radially offset from axis 255. A first radial bore 256*a* extends radially outward from counterbore 254*a* to outer surface 252 and a a second radial bore 256*b* extends radially outward from counterbore 254*b* to outer surface 252.

A pair of axially-spaced seal assemblies 260 are provided in throughbore 251 and each counterbore 254*a*, 254*b*. Each seal assembly 260 includes an annular recess formed along the inner surface of the corresponding throughbore 251, counterbore 254*a*, 254*b* and an annular seal member seated in the recess.

Referring still to FIG. 7, tubing hanger 280 is seated in passage 32 of housing 31 with shoulder 282*b* seated against mating upward-facing seat 72 of casing hanger 70. A pair of annular seal assemblies 289 are radially disposed between body 281 and housing 31, thereby preventing fluid flow therebetween. Frustoconical surface 282*a* is releasably engaged by retention pins 39*a* previously described, shoulder 282*b* axially abuts and engages annular seat 73 of casing hanger 70, and cylindrical surface 282*c* slidingly engages housing 31. Head 250 is secured to housing 31 with neck 295 extending into coaxially aligned throughbore 251. Seal assemblies 260 provided in throughbore 251 form annular seals between head 250 and neck 295.

A pair of tubular penetrators 291 extend between body 281 and head 250. In particular, each penetrator 291 has a first or upper end 291*a*, a second or lower end 291*b*, a central through bore 292 extending axially between ends 291*a*, 291*b*, and a radially outer surface 293 extending axially between ends 291*a*, 291*b*. Upper ends 291*a* are slidingly disposed in counterbores 254*a*, 254*b*, and lower ends 291*b* are threaded into bores 286, 287. A pair of axially-spaced annular seal assemblies 294 are provided between each end 291*a* and head 250, and between each end 291*b* and body 281. Each annular seal assembly 294 includes an annular recess provided in outer surface 293 and an annular sealing member seated in the recess.

An alignment pin 43 extends radially inward into housing 31 and slidingly engages notch 283*d*. The lateral sides or edges of notch 283*d* taper toward each other moving upward from shoulder 282*b*. Thus, notch 283*d* functions as a funnel that guides pin 43 as pin 43 is slidingly received into notch 283*d* upon installation of tubing hanger 280 into housing 31. In this manner, engagement of pin 43 and notch 283*d* provide a means for rotationally orienting tubing hanger 180 within housing 31. It should be appreciated that alignment pin 43 and a funnel or guide notch (e.g., notch 283*d*) are included in housing 31 and tubing hanger body 81 previously described and shown in FIG. 3, but are not visible in FIGS. 3-5 due to the plane in which the cross-sections were taken.

Referring still to FIG. 7, production system 210 including concentric tubing hanger 280 provides for multiple independent flow paths for producing fluids. Specifically, a first production fluid flowpath 220 is provided through outer annulus 25 and ports 37*b* in housing 31; a second production fluid flowpath 221 is provided through inner annulus 226, ports 77 of casing hanger 70, and ports 37*a* in housing 31; and a third production fluid flowpath 222 is provided through tubing 228, production bore 282 of tubing hanger 280, and throughbore 251 of head 250.

The plurality production passages provided in both the dual bore tubing hanger configuration and concentric tubing hanger configuration may provide a greater amount of flexibility in controlling fluid flow and pressure within borehole 12 relative to other wellheads that only provide for a single production passage. For instance, while producing fluid from the borehole 12 one or more production passages (e.g., the primary, secondary and tertiary routes of fluid communication) may be opened or closed using valves 41, which may vary the flow restriction of such formation fluids as they flow from the borehole 12 to the wellhead 30. Further, the flexibility and additional functionality offered by providing a plurality of production passages in the wellhead 30 may obviate the need for additional surface equipment coupled to the wellhead such as a production tree. By eliminating the need for a separate production tree, embodiments of wellhead 30 offer the potential for a more compact wellhead that still provides multiple production flow paths, as well as an injection flow path. Moreover, additional flexibility and functionality is provided by the ability to quickly and conveniently switch between the dual bore and concentric configurations of wellhead 30. Specifically, only the head (i.e., heads 50 and 150) and tubing hanger (i.e., tubing hangers 80 and 180) of wellhead 30 need be exchanged to switch between the dual bore and concentric configurations, It should also be appreciated that casing hanger 70 and tubing hanger 80 are in a "stacked" arrangement within housing 31 of wellhead 30. Such stacked arrangement allows ports 37*a*, 37*b* to be axially spaced from one another, allowing for a relatively reduced diameter of the outer surface 36 of housing 31 relative to other wellhead designs. This reduction in diameter of the outer surface 36 of housing 31 may allow wellhead 30 to be displaced axially through the deck of a drilling rig, such as through the aperture used by the rig's rotary table when wellhead 30 is coupled to the outer casing 20 during installation. Also, the multiple annuli design (e.g., inner annulus 25 and outer annulus 26), provides for a relatively shorter axial length of wellhead 30, positioning flanges 31 and 53 proximal the surface 11 for added convenience and safety.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A production system for producing hydrocarbons from a subterranean reservoir, the system comprising:

a wellhead including a housing and a head mounted to the housing;

wherein the housing has a central axis, an upper end, a lower end configured to be directly attached to an upper end of a primary conductor, and an inner surface extending axially between the upper end and the lower end the inner surface defining a passage extending axially through the housing;

wherein the inner surface of the housing includes an annular recess axially positioned between the upper end and the lower end;

wherein the housing includes a first production port extending radially through the housing from the annular recess to a radially outer surface of the housing;

wherein the upper end of the casing hanger comprises an annular landing surface;

a casing hanger disposed within the housing, the casing hanger having an upper end, a lower end, an outer surface, and a through bore extending from the upper end to the lower end;

wherein the casing hanger includes a plurality of circumferentially-spaced ports extending radially through the casing hanger from the through bore to the annular recess of the housing;

a tubing hanger disposed within the housing, the tubing hanger having an upper end, a lower end, an outer surface and a through bore extending from the upper end to the lower end;

wherein the tubing hanger is seated against the annular landing surface of the casing hanger.

2. The production system of claim 1, further comprising:

a first upper seal assembly axially disposed above the annular recess and radially disposed between the housing and the casing hanger; and a first lower seal assembly axially disposed below the annular recess and radially disposed between the housing and the casing hanger.

3. The production system of claim 2, further comprising:

a second upper seal assembly axially disposed above the annular recess and radially disposed between the housing and the casing hanger; and a second lower seal assembly axially disposed below the annular recess and radially disposed between the housing and the casing hanger.

4. The production system of claim 1, further comprising:

wherein the outer surface of the tubing hanger includes an annular frustoconical surface at the upper end of the tubing hanger;

wherein a plurality of circumferentially-spaced retention pins extend radially through the housing and into engagement with the frustoconical surface of the tubing hanger.

5. The production system of claim 1, wherein the outer surface of the casing hanger includes an annular recess proximal the upper end of the casing hanger;

wherein a plurality of circumferentially-spaced retention pins extend radially through the housing into the upper annular recess.

6. The production system of claim 1, wherein the housing includes a second production port extending radially through the housing from the inner surface of the housing to the outer surface of the housing.

7. A production system for producing hydrocarbons from a subterranean reservoir, the system comprising:

a wellhead including a housing having a central axis, an upper end, a lower end configured to be directly attached to an upper end of a primary conductor, and an inner surface extending axially between the upper end and the lower end, the inner surface defining a passage extending axially through the housing;

a casing hanger disposed within the housing, the casing hanger having an upper end, a lower end, an outer surface, and a through bore extending from the upper end to the lower end;

a casing string coupled to the lower end of the casing hanger;

a tubing hanger disposed within the housing, the tubing hanger having an upper end, a lower end, an outer surface and a through bore extending from the upper end to the lower end, wherein the tubing hanger is seated against an annular landing surface disposed at the upper end of the casing hanger;

a tubing string coupled to the lower end of the tubing hanger and extending through the casing string;

wherein a first production port in the housing is in fluid communication with a first annulus radially disposed between the primary conductor and the casing string and a second production port in the housing is in fluid communication with a second annulus radially disposed between the casing string and the tubing string.

8. The production system of claim 7, further comprising:

an annular recess formed on the inner surface of the housing;

wherein the second production port extends radially through the housing to the annular recess; and wherein the casing hanger includes a plurality of circumferentially-spaced ports extending radially from through bore of the casing hanger to the annular recess of the housing.

9. The production system of claim 7, wherein the tubing hanger includes an injection passage extending from the upper end to the lower end of the tubing hanger.

10. The production system of claim 9, further comprising:

a plurality of annular seal assembly radially disposed between the housing and the tubing hanger.

11. The production system of claim 9, wherein the upper end of the tubing hanger comprises an annular frustoconical surface; and a plurality of circumferentially-spaced retention pins extending radially through the housing and into engagement with the annular frustoconical surface of the tubing hanger.

12. The production system of claim 9, further comprising:

a head coupled at the upper end of the housing and having a first passage extending therethrough; and a tubular penetrator extending axially between the tubing hanger and the head, wherein the penetrator is in fluid communication with the first passage and the injection passage.

13. The production system of claim 12, wherein the head has a second passage extending therethrough;

wherein the production passage of the tubing hanger is in fluid communication with the second passage.

14. The production system of claim 13, wherein the injection passage and the production passage are radially offset from the central axis of the housing.

15. A method for producing hydrocarbons from a subterranean reservoir, the method comprising:

(a) flowing a first fluid stream radially through a casing hanger into an annular recess formed on the inner surface of a wellhead secured to an upper end of a primary conductor;

(b) flowing the first fluid stream through the annulus to a first production port extending radially through the housing;

(c) flowing the first fluid stream through an inner annulus radially disposed between an inner casing string and a production tubing (d) flowing a second fluid stream through an outer annulus radially disposed between the inner casing string and a primary conductor;

(e) flowing the second fluid stream into the housing and through a second production port extending radially through the housing.

16. The method of claim 15, further comprising:

(f) flowing a third fluid stream through the production tubing and a tubing hanger disposed within the wellhead axially above the casing hanger.

17. The method of claim 16, further comprising:

(g) flowing the third fluid stream through a passage in a head mounted to the housing.

18. The method of claim 15, further comprising:

injecting a fluid into the formation through an injection tubing extending from the tubing hanger through the inner casing string.

* * * * *